US010752983B2

(12) United States Patent
Wang et al.

(10) Patent No.: US 10,752,983 B2
(45) Date of Patent: Aug. 25, 2020

(54) SYSTEM AND PROCESS FOR REMANUFACTURING WASTE CYLINDER ASSEMBLY OF AIRCRAFT PISTON ENGINE

(71) Applicant: Army Academy of Armored Forces, Beijing (CN)

(72) Inventors: Haidou Wang, Beijing (CN); Guozheng Ma, Beijing (CN); Pengfei He, Beijing (CN); Shuying Chen, Beijing (CN); Fajun Ding, Beijing (CN); Yiwen Wang, Beijing (CN); Ming Liu, Beijing (CN); Haijun Wang, Beijing (CN); Shuyu Ding, Beijing (CN)

(73) Assignee: Army Academy of Armored Forces, Beijing (CN)

( * ) Notice: Subject to any disclaimer, the term of this patent is extended or adjusted under 35 U.S.C. 154(b) by 15 days.

(21) Appl. No.: 16/038,541

(22) Filed: Jul. 18, 2018

(65) Prior Publication Data

US 2019/0071761 A1 Mar. 7, 2019

(30) Foreign Application Priority Data

Sep. 7, 2017 (CN) ..... 2017 1 0801245

(51) Int. Cl.
*C23C 4/134* (2016.01)
*B05B 13/06* (2006.01)
(Continued)

(52) U.S. Cl.
CPC ..... *C23C 4/134* (2016.01); *B05B 13/0221* (2013.01); *B05B 13/0285* (2013.01); *B05B 13/0421* (2013.01); *B05B 13/0636* (2013.01); *C23C 4/02* (2013.01); *C23C 4/067* (2016.01); *C23C 4/073* (2016.01); *C23C 4/08* (2013.01); *C23C 4/11* (2016.01); *C23C 4/16* (2013.01);
(Continued)

(58) Field of Classification Search
CPC ..... B05B 13/0636; B05B 13/0654; B05B 13/0681; B05B 13/069; B05B 7/22–226; C23C 4/129–134
See application file for complete search history.

(56) References Cited

U.S. PATENT DOCUMENTS 5,194,304 A * 3/1993 McCune, Jr. ..... B05B 13/0636 427/224
5,245,153 A * 9/1993 Singer ..... B05B 13/0636 219/76.15
(Continued)

*Primary Examiner* — Binu Thomas
(74) *Attorney, Agent, or Firm* — Crain Caton and James

(57) ABSTRACT

Provided are a system and process for remanufacturing a waste cylinder assembly of an aircraft piston engine. The spraying apparatus includes a first power mechanism, a spray gun assembly and a second power mechanism. The first power mechanism drives the cylinder assembly to move in a horizontal direction and a vertical direction. The second power mechanism drives the spray gun assembly to rotate around a center of the blind hole and ensures that prepared coatings can be evenly distributed along an inner wall of the blind hole. A nozzle end of the spray gun extends into the blind hole, and the spray gun is adjustable relative to the center of the blind hole. A spraying distance is not fixed so as to change the spraying distance. Powder can be fully melted.

12 Claims, 9 Drawing Sheets

(51) Int. Cl.

| | |
|---|---|
| ***B05B 13/04*** | (2006.01) |
| ***B05B 13/02*** | (2006.01) |
| ***C23C 4/16*** | (2016.01) |
| ***B05B 7/22*** | (2006.01) |
| ***C23C 4/067*** | (2016.01) |
| ***C23C 4/073*** | (2016.01) |
| ***C23C 4/11*** | (2016.01) |
| ***C23C 4/02*** | (2006.01) |
| ***C23C 4/08*** | (2016.01) |

(52) U.S. Cl.
CPC ..... *B05B 7/226* (2013.01); *B22F 2998/10* (2013.01); *B22F 2999/00* (2013.01)

(56) References Cited

U.S. PATENT DOCUMENTS

| | | | | |
|---|---|---|---|---|
| 5,271,967 | A * | 12/1993 | Kramer | C23C 4/12 29/888.061 |
| 5,452,854 | A * | 9/1995 | Keller | B05B 13/0636 239/80 |
| 5,707,693 | A * | 1/1998 | Vliet | B05B 13/0636 427/236 |
| 2005/0186355 | A1* | 8/2005 | Miyamoto | C23C 4/131 427/446 |
| 2007/0130746 | A1* | 6/2007 | Sugiyama | B05B 13/0285 118/300 |
| 2009/0104348 | A1* | 4/2009 | Terada | B05B 13/0636 427/236 |
| 2011/0005457 | A1* | 1/2011 | Takahash | C23C 4/16 118/317 |

* cited by examiner

SYSTEM AND PROCESS FOR REMANUFACTURING WASTE CYLINDER ASSEMBLY OF AIRCRAFT PISTON ENGINE

CROSS-REFERENCES TO RELATED APPLICATIONS

This application claims priority to Chinese patent application No. CN201710801245.8, filed on Sep. 7, 2017, the disclosure of which is incorporated herein by reference in its entirety.

TECHNICAL FIELD

The present invention relates to the technical field of remanufacturing, and particularly relates to a system and process for remanufacturing a waste cylinder assembly of an aircraft piston engine.

BACKGROUND

An aircraft piston engine is a main power plant of a general aviation aircraft. Frictional wear of a cylinder-piston assembly is one of main mechanical faults of an aircraft engine system. As shown in FIG. 1, the cylinder-piston assembly includes a cylinder assembly 11, a piston 12 and a connecting 13. The cylinder assembly 11 includes a cylinder barrel 111 and a cylinder head 112. Part of the cylinder barrel 111 extends into the cylinder head and is matched with the cylinder head 112. The cylinder barrel 111 is formed by forging high-strength steel alloy with high price. An integral radiating fin is arranged in the middle, and an inner surface is nitrogenized and precisely honed into specific flat-top mesh. The cylinder head 112 is formed by casting aluminum alloy, has the characteristics of good thermal conductivity, light weight and the like, can remarkably reduce the integral weight of the engine, and structurally includes an air inlet rocker arm, an air outlet rocker arm, a spark plug, an air inlet valve 1121, an air outlet valve 1122, a radiating fin and the like. Therefore, the cylinder assembly 11 has high technical complexity and high value-added, and has important maintenance and remanufacturing values.

The aircraft piston engine is always under harsh working conditions of intermittent operation (long-term parking and occasional flight), full-power operation (takeoff, creeping, full-speed flight and other phases) and instable cooling (a cooling effect is relevant to advancing speed of the aircraft), especially, a position of a stop point on the cylinder-piston assembly often forms a semi-dry friction or dry friction state due to high-temperature combustion of lubricating oil. In addition, gas pressure, speed and direction of a movement of a piston 12 are in changed rapidly. Therefore, the cylinder and a piston ring are prone to wear, scratch and even fracture, and the mesh on the inner surface of the cylinder barrel 111 is prone to wear. The wear failure of the cylinder-piston assembly occupies 45%-65% of the frictional wear fault of the aircraft piston engine, and also directly causes short overhaul time interval and service life of the aircraft piston engine.

Since assembly and disassembly of the cylinder barrel 111 and the cylinder head 112 of the aircraft piston engine need a special necking-bulging technology. If a waste cylinder assembly 11 is disassembled in an overhaul process, this process has lost remanufacturing value and significance from the perspective of reliability and economy. Therefore, in the case where the cylinder barrel 111 is not disassembled, a hole in the cylinder barrel 111 is a blind hole 1111.

At present, for deep maintenance of the waste cylinder assembly 11 of the aircraft piston engine, a foreign traditional "cylinder expansion+honing" maintenance mode still dominates. This maintenance mode not only requires high processing accuracy to satisfy a dimensional allowance standard, but also requires to select a larger nonstandard piston assembly, thereby causing interchangeability damage of parts, limited maintenance times and low utilization ratio of waste elements, and further causing high use and maintenance cost of the aircraft piston engine and great waste of value-added and also affecting the service life and flight safety of the general aviation aircraft and a military UAV.

Existing plasma spraying of an inner hole includes two modes. The first mode is as follows: a workpiece rotates (on a lower side), and a spray gun moves up and down (on an upper side) along a vertical direction. However, since a structure of the cylinder head 112 of the aircraft piston engine is complicated and not symmetrical (e.g., different numbers of radiating fins with different sizes are distributed around the cylinder head 112), a center of gravity of the cylinder assembly 11 is not in a center of the blind hole. The cylinder assembly 11 is not stably and is easy to being eccentric during high-speed rotation, thereby causing uneven mass and thickness of prepared coatings. Meanwhile, dust is easier to sink and accumulate in the blind hole with an upward opening, and is difficult to remove, thereby causing pollution to the coating and affecting coating quality. The other mode is as follows: the workpiece is fixed (on a lower side), and the spray gun rotates (on an upper side). The spray gun is positioned in a center of the inner hole, and a spraying distance is fixed and is smaller than a radius of the inner hole, but the inner diameter of the blind hole of the cylinder assembly 11 is small and a short spraying distance is not enough to melt the powder, thereby generating a large number of powder and inclusions in the coating and reducing coating quality. Meanwhile, short-distance spraying causes a rapid temperature rise of the cylinder assembly 11 and a great deformation.

Therefore, the existing plasma spraying modes of the inner hole are only suitable for material-adding repair of through holes, large holes and regular inner holes. For the waste cylinder assemblies 11 of the aircraft piston engine with precise and complicated structure, asymmetry, small aperture and high strength of blind hole and inner wall, high-quality remanufacturing for these waste cylinder assemblies 11 of the aircraft piston engine cannot be realized through an existing technical solution. Scratch, wear, corrosion and other failure manners generated on the inner wall of the cylinder barrel 111 currently cannot be effectively repaired, thereby causing low utilization ratio of waste elements, poor part interchangeability and reduced overall performance, generating a large number of scrapped cylinders and causing huge resource waste and economic loss.

SUMMARY

The present disclosure aims to provide a system and process for remanufacturing a waste cylinder assembly of an aircraft piston engine, which are used for performing plasma spraying on a blind hole of the cylinder assembly, so as to solve problems of the waste cylinder assembly of the existing aircraft piston engine such as low success repairing rate, high maintenance cost, resource waste and large economic loss of the waste cylinder assembly and to overcome technical defects such as a great thermal deformation of a cylinder barrel and serious dust pollution to the blind hole caused by instable and easily eccentric rotation of a workpiece, uneven coating quality, limited spraying distance of a small hole, and excessive heat accumulation in an existing plasma spraying process of the blind hole.

As conceived above, the present disclosure adopts the following technical solution.

A system for remanufacturing a waste cylinder assembly of an aircraft piston engine, being configured to perform plasma spraying on a blind hole of the cylinder assembly, includes a spraying apparatus. The spraying apparatus includes: a first power mechanism, a spray gun assembly, and a second power mechanism.

The first power mechanism is configured to drive the cylinder assembly to move in a horizontal direction and a vertical direction, and the first power mechanism is connected with the blind hole in such a manner that an opening of the blind hole is downward.

The spray gun assembly includes a spray gun and a spray gun supporting seat. A nozzle end of the spray gun extends into the blind hole, a pipeline end of the spray gun is slidably connected with the spray gun supporting seat, and a distance from the spray gun to a rotating center of the spray gun assembly is adjustable.

The second power mechanism is configured to drive the spray gun assembly to rotate around a center of the blind hole.

In an exemplary embodiment, a lower end of the spray gun is slidably connected with the spray gun supporting seat through an installing block and the spray gun assembly further includes: a counterweight and a pipeline.

The counterweight arranged on the spray gun supporting seat and configured to hold dynamic balance of the spray gun during rotation.

One end of the pipeline penetrates through the spray gun supporting seat and the installing block and is connected with the spray gun, the other end of the pipeline is connected with a slip ring assembly, and the second power mechanism is connected with the spray gun assembly through the slip ring assembly.

In an exemplary embodiment, the spray gun supporting seat includes a first flange and a second flange. The first flange and the second flange are connected through a plurality of connecting rods. The first flange is provided with a chute, and the installing block is slidably connected with the chute and is positioned and fastened through a locking member.

In an exemplary embodiment, the second power mechanism and the slip ring assembly are located in a housing and the slip ring assembly includes: a stator, a rotor flange, and a transition drum.

The stator is fixedly connected with the housing through a stator rotation stopping piece, and an inlet end of the pipeline is located on the stator side.

The rotor flange is rotatably connected to an upper end of the stator.

An upper end of the transition drum is connected with the spray gun supporting seat, a lower end is connected with the rotor flange and the pipeline penetrates through the rotor flange and also penetrates through an inner cavity of the transition drum.

In an exemplary embodiment, the second power mechanism includes: a driving pulley and a driven pulley.

The driving pulley is connected with an output end of a motor which is fixedly connected with the housing.

The driven pulley is connected with the driving pulley through a belt, sleeved on an outer surface of the transition drum and fixedly connected with the transition drum.

In an exemplary embodiment, the outer surface of the transition drum is also sleeved by a bearing assembly, and the bearing assembly includes: a bearing seat, a bearing, a first lock nut, and a second lock nut.

The bearing seat is fixedly connected with the housing.

The bearing is installed on the bearing seat and sleeved on the outer surface of the transition drum. The bearing includes a first bearing located above the driven pulley and a second bearing located below the driven pulley. Spacer rings are arranged between the driven pulley and the first bearing, between the driven pulley and the second bearing, and between the second bearing and a convex edge of a lower end of the transition drum. The driven pulley is fixedly connected with the spacer rings.

The first lock nut located on an upper end of the first bearing and fixedly sleeved on the transition drum to axially locate the first bearing.

The second lock nut located on a lower end of the second bearing and fixedly sleeved on the transition drum to axially locate the second bearing.

In an exemplary embodiment, the first power mechanism includes: a vertical regulating mechanism and a horizontal regulating mechanism.

The vertical regulating mechanism includes a first supporting plate connected with the cylinder assembly and a second supporting plate slidably connected with the first supporting plate. The first supporting plate is provided with a through hole corresponding to the blind hole.

The horizontal regulating mechanism includes a base connected to a lower end of the second supporting plate, and the second supporting plate is slidably connected with a sliding rail on the base.

In an exemplary embodiment, the system further includes a cooling apparatus located at a periphery of a cylinder barrel of the cylinder assembly. The cooling apparatus includes a water cooling assembly. The water cooling assembly includes a circulating water barrel sleeved on the cylinder barrel; an annular water cavity is formed between the circulating water barrel and the cylinder barrel; and a side wall of the circulating water barrel is provided with a water inlet and a water outlet which are communicated with the annular water cavity.

The cooling apparatus further includes an air cooling assembly. The air cooling assembly includes an annular air pipe sleeved on a cylinder head of the cylinder assembly. The annular air pipe is located above the circulating water barrel and located at a matching part between the cylinder barrel and the cylinder head, and an inner circumferential surface of the annular air pipe which faces a radiating fin of the cylinder head is evenly provided with a plurality of blowing holes communicated with an inner cavity of the annular air pipe.

In an exemplary embodiment, the system further includes a dust removal apparatus which includes: an annular air jetting pipe and an air jetting channel.

The annular air jetting pipe is located below the cylinder assembly. A circumferential surface of the annular air jetting pipe close to the cylinder assembly is provided with a plurality of air jetting holes communicated with an inner cavity of the annular air jetting pipe and configured to jet air to an inner wall of the blind hole.

An air jetting channel includes a first air channel and a second air channel. The first air channel is communicated with an air inlet hole in the cylinder head of the cylinder assembly and the second air channel is communicated with an air outlet hole in the cylinder head.

The dust removal apparatus further includes a dustproof shielding cap which is detachably located in the cylinder barrel of the cylinder assembly and installed at the matching part between the cylinder barrel and the cylinder head to shield a combustion chamber of the cylinder head.

A process for remanufacturing a waste cylinder assembly of an aircraft piston engine is provided. The method is used for performing plasma spraying on a blind hole of the cylinder assembly and includes the following steps.

Performing pretreatment the waste cylinder assembly (11), where the pretreatment includes: machining, washing, drying and sand blasting.

Jointly adjusting the remanufacturing system: adjusting a position of the cylinder assembly through a first power mechanism; keeping an opening of the blind hole downward and aligning a center of the blind hole with a rotating center of a spray gun assembly to adjust a distance from the spray gun to the center of the blind hole.

Preparing a plasma spraying layer: in a spraying process, moving the cylinder assembly only in a vertical direction and rotating the spray gun continuously only in a horizontal plane, and forming a coating on an inner wall of the blind hole through movements of the cylinder assembly and the spray gun.

Post-processing the coating: honing the coating on the inner wall of the blind hole to achieve a surface roughness of Ra 0.635 μm-0.889 μm, and forming a mesh pattern with a cross angle of 45 degrees.

The present disclosure has the following beneficial effects.

The system and process for remanufacturing the waste cylinder assembly of the aircraft piston engine proposed by present disclosure are configured to perform plasma spraying on the blind hole of the cylinder assembly. The system includes: a spraying apparatus. The spraying apparatus includes: a first power mechanism, a spray gun assembly, and a second power mechanism. The first power mechanism drives the cylinder assembly to move in a horizontal direction and a vertical direction and ensures firm positioning of the cylinder assembly. The second power mechanism drives the spray gun assembly to rotate around a center of the blind hole and ensures that prepared coatings can be evenly distributed along an inner wall of the blind hole. A nozzle end of the spray gun extends into the blind hole; a pipeline end of the spray gun is slidably connected with a spray gun supporting seat. The spray gun is adjustable relative to the center of the blind hole, and the spray gun can deviate from the center of the blind hole. A spraying distance is not fixed so as to change the spraying distance. Powder can be fully melted, thereby achieving good coating quality, avoiding heat accumulation and reducing thermal deformation of the cylinder assembly. The blind hole is connected with the first power mechanism in such a manner that an opening of the blind hole is downward, thereby preventing dust from accumulating in the blind hole, reducing dust pollution, and benefiting heat dissipation.

11. cylinder assembly; 111. cylinder barrel; 1111. blind hole; 112. cylinder head; 1121. air inlet valve; 1122. air outlet valve; 1123. air inlet valve seat; 1124. air outlet valve seat; 1125. air inlet hole; 1126. air outlet hole; 1127. spark plug installing hole; 12. piston; 13. connecting rod;

21. first power mechanism; 22. spray gun assembly; 23. second power mechanism; 24. slip ring assembly; 25. bearing assembly; 26. housing; 211. first supporting plate; 212. second supporting plate; 213. base; 214. first sliding seat;

215. second sliding seat; 216. first driving apparatus; 217. speed reducer; 218. leading screw;

221. spray gun; 222. spray gun supporting seat; 223. counterweight; 224. installing block; 225. pipeline; 2221. first flange; 2222. second flange; 2223. connecting rod; 22211. chute;

231. driving pulley; 232. driven pulley; 233. motor; 234. belt;

241. stator; 242. transition drum; 243. rotor flange; 244. stator rotation stopping piece;

251. bearing seat; 252. bearing; 253. spacer ring; 254. first lock nut; 255. second lock nut;

31. circulating water barrel; 32. water inlet; 33. water outlet; 34. O type seal ring; 35. annular air pipe; 351. blowing hole;

41. annular air jetting pipe; 42. air jetting pipeline; 43. dustproof shielding cap; 411. air jetting hole; 421. first air channel; 422. second air channel; 431. first round hole; 432. second round hole; and 433. positioning hole.

DETAILED DESCRIPTION

Technical solutions of the present disclosure are further described below in conjunction with drawings and embodiments. It can be understood that specific embodiments described herein are only used to explain the present disclosure, not to limit the present disclosure. In addition, it should be noted that to facilitate description, part of embodiments related to the present disclosure, not all of embodiments, are shown only in drawings.

Figure 1:
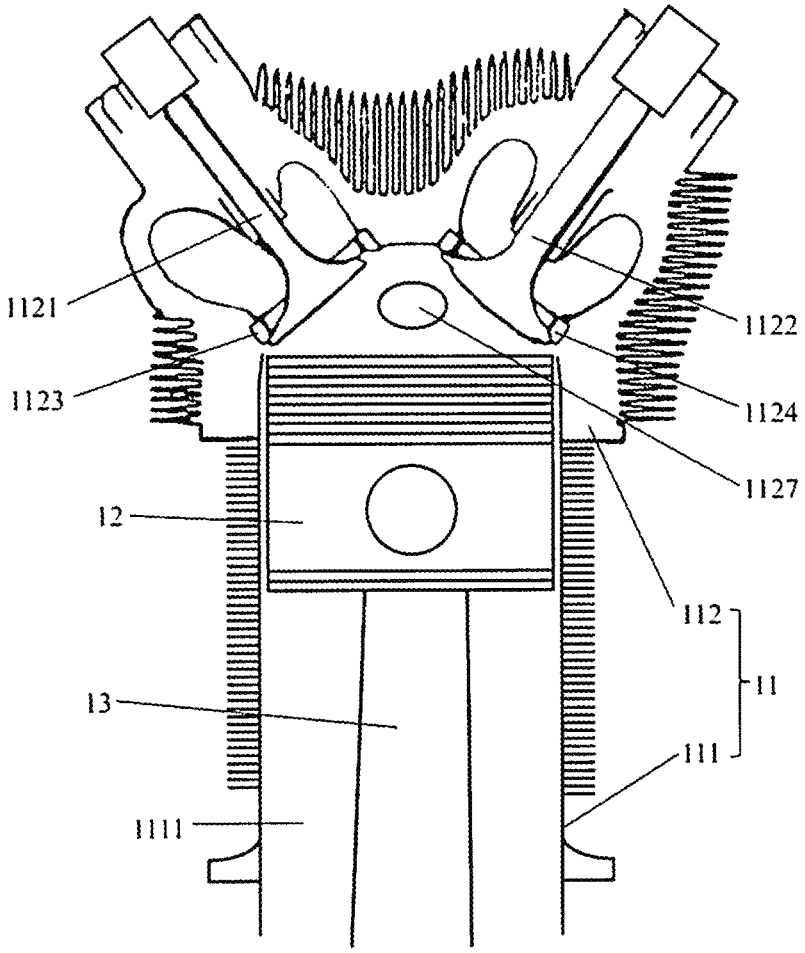
FIG. 1 (Prior Art)
FIG. 1 is a structural schematic diagram illustrating a cylinder-piston assembly of an existing aircraft piston engine.
Figure 2:
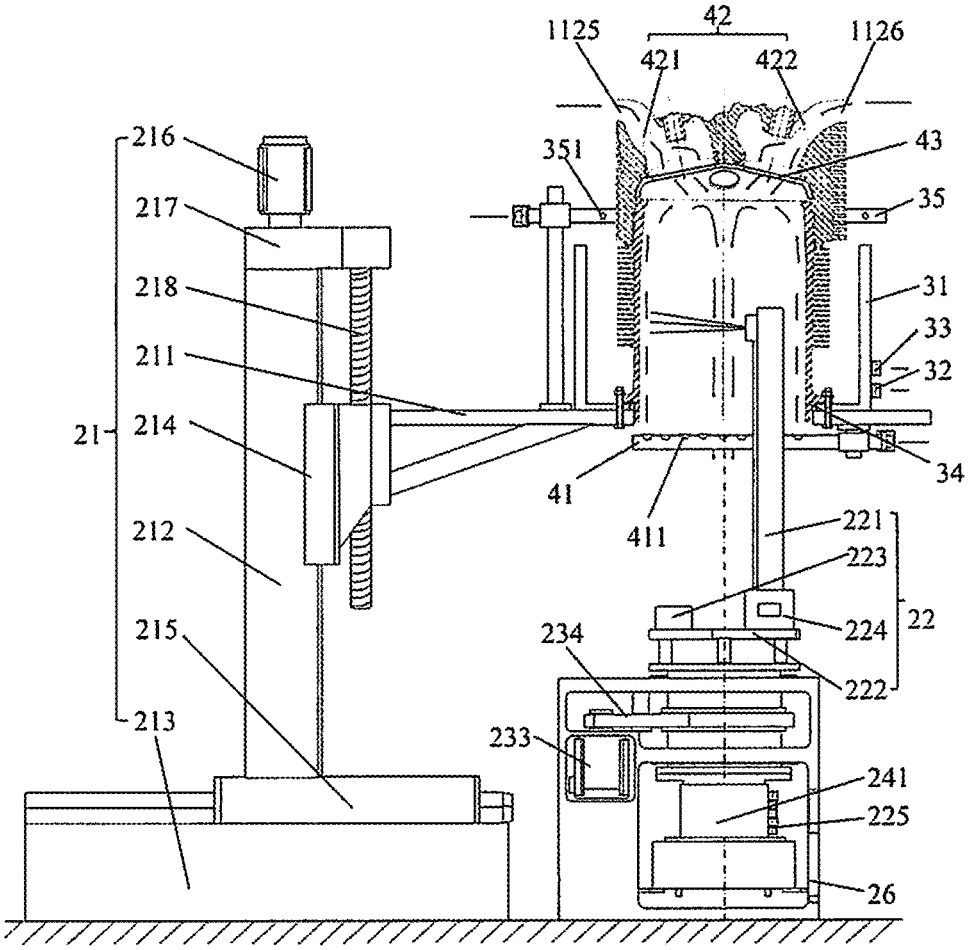
FIG. 2 is a structural schematic diagram illustrating a system for remanufacturing a waste cylinder assembly of an aircraft piston engine provided by the present disclosure.
Figure 3:
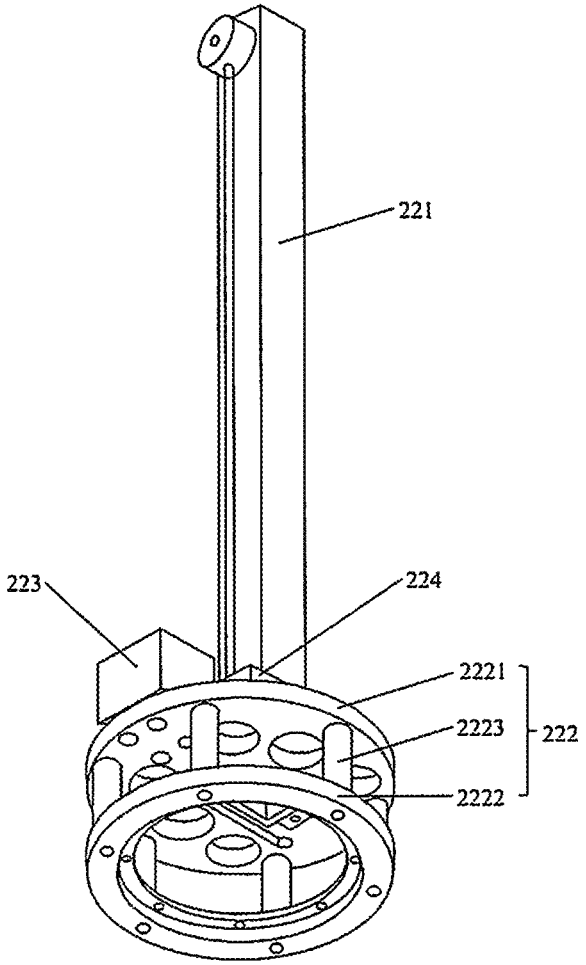
FIG. 3 is a structural schematic diagram illustrating a spray gun assembly in FIG. 2.
Figure 4:
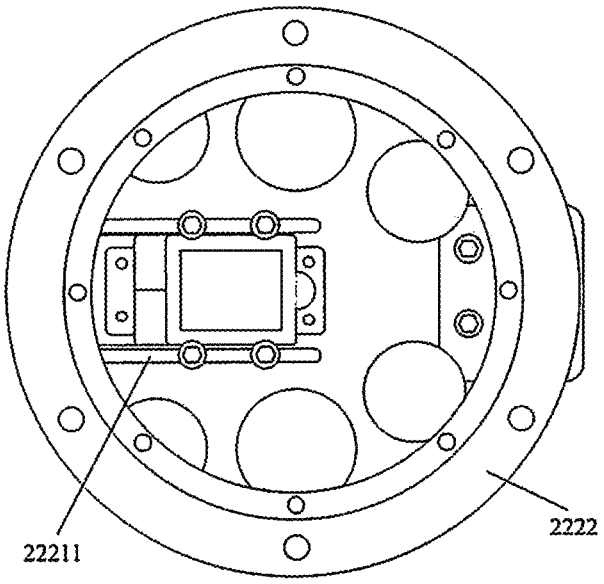
FIG. 4 is a bottom view of the spray gun assembly in FIG. 3.
Figure 5:
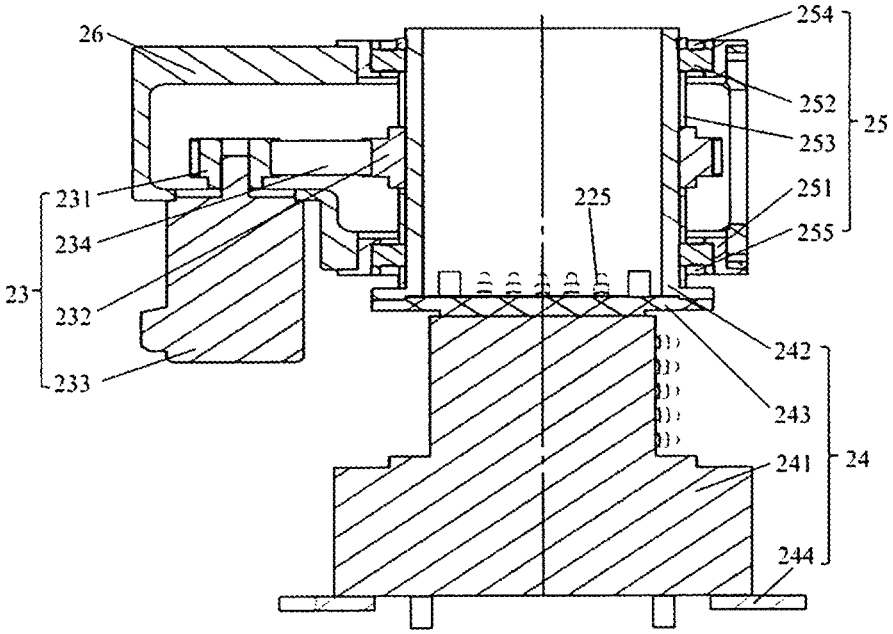
FIG. 5 is a sectional view illustrating an interior of a housing in FIG. 2.

By referring to FIG. 2, a system for remanufacturing a waste cylinder assembly of an aircraft piston engine is used to conduct plasma spraying on a blind hole 1111 of an abraded cylinder assembly 11. The system includes a spraying apparatus, a cooling apparatus and a dust removal apparatus. The spraying apparatus is configured to conduct a spraying process on the blind hole 1111. The cooling apparatus is configured to reduce temperature in the spraying process. The dust removal apparatus is configured to remove dust in the blind hole 1111 in the spraying process.

The spraying apparatus includes a first power mechanism 21, a spray gun assembly 22 and a second power mechanism 23. The first power mechanism 21 is configured to drive the cylinder assembly 11 to move in a horizontal direction and a vertical direction and ensure firm positioning of the cylinder assembly 11. The second power mechanism 23 is configured to drive the spray gun assembly 22 to rotate around a center of the blind hole 1111 and ensure that prepared coatings can be evenly distributed along an inner wall of the blind hole 1111. The spray gun assembly 22 includes a spray gun 221 and a spray gun supporting seat 222. An upper end of the spray gun 221 is a nozzle end, and a lower end of the spray gun 221 is a pipeline end. The nozzle end of the spray gun 221 extends into the blind hole 1111. The pipeline end of the spray gun 221 is slidably connected with the spray gun supporting seat 222. The spray gun 221 is adjustable relative to the center of the blind hole 1111. The spray gun 221 can be located at the center of the blind hole 1111 when an aperture of the blind hole 1111 is larger; and the spray gun 221 can deviate from the center of the blind hole 1111 when the aperture of the blind hole 1111 is smaller. A spraying distance is not fixed such that the spraying distance can be changed. Powder can be fully melted, thereby achieving good coating quality, avoiding heat accumulation and reducing deformation of the cylinder assembly 11. The blind hole 1111 is connected with the first power mechanism 21 in such a manner that an opening of the blind hole 1111 is downward, thereby preventing dust from accumulating in the blind hole 1111, reducing dust pollution and benefiting heat dissipation. A rotating center of the spray gun assembly 22 is the center of the blind hole 1111. As shown by an arrow direction in FIG. 2, the spray gun assembly 22 rotates in X-Y plane, and a rotating axis is perpendicular to the X-Y plane.

The first power mechanism 21 includes a vertical regulating mechanism and a horizontal regulating mechanism. The vertical regulating mechanism includes a first supporting plate 211 connected with the cylinder assembly 11 and a second supporting plate 212 slidably connected with the first supporting plate 211. One end of the first supporting plate 211 is connected with the cylinder assembly 11, and the other end is slidably connected with the second supporting plate 212 through a first sliding seat 214. The first supporting plate 211 can vertically slide along the second supporting plate 212, as shown by Z direction in FIG. 2. The cylinder assembly 11 is fixed to the first supporting plate 211. A through hole corresponding to the blind hole 1111 is formed in the first supporting plate 211. The spray gun 221 can run through the through hole and extends into the blind hole 1111. The horizontal regulating mechanism includes a base 213 connected to a lower end of the second supporting plate 212. A sliding rail is arranged on the base 213. The second supporting plate 212 is connected with the sliding rail through a second sliding seat 215 in a sliding mode. The second supporting plate 212 can horizontally slide along the base 213, as shown by X direction in FIG. 2.

A first driving apparatus 216 is arranged on an upper end of the second supporting plate 212. The first driving apparatus 216 is connected with the first sliding seat 214 through a leading screw 218. In the present embodiment, the first driving apparatus 216 is a motor, and a speed reducer 217 is arranged between the motor and the leading screw 218. A second driving apparatus is arranged on the base 213. The second driving apparatus is connected with the second sliding seat 215. In the present embodiment, the second driving apparatus is a hydraulic cylinder. A position of the cylinder assembly 11 can be adjusted through the first driving apparatus 216 and the second driving apparatus. During adjustment, a rotating direction and rotating speed are controlled by the motor, and the leading screw 218 is driven to rotate through the speed reducer 217, so as to drive the first supporting plate 211 to move in the vertical direction. When the horizontal position of the cylinder assembly 11 needs to be adjusted, the hydraulic cylinder drives the second supporting plate 212 to slide along the sliding rail. After adjustment, the leading screw 218 and the hydraulic cylinder can be automatically positioned to ensure firmness of the cylinder assembly 11.

By referring to FIG. 2 to FIG. 5, the spray gun assembly 22 also includes a counterweight 223. The lower end of the spray gun 221 is slidably connected with the spray gun supporting seat 222 through the installing block 224. The counterweight 223 is arranged on the spray gun supporting seat 222. Dynamic balance of the spray gun 221 during rotation is kept by increasing weight of a mechanism to ensure stability of the spray gun 221 during high-speed rotation. For different spray distances and rotating speeds of the spray gun, relative positions of the spray gun 221 and the counterweight 223 can be regulated according to actual conditions and the weight of the counterweight 223 can be set according to the actual conditions. The spray gun supporting seat 222 includes a first flange 2221 and a second flange 2222. The first flange 2221 and the second flange 2222 are connected through a plurality of connecting rods 2223. Chutes 22211 are formed in the first flange 2221. The installing block 224 is connected with the chutes 22211 in a sliding mode and is positioned and fastened through locking members. In the present embodiment, two chutes 22211 are arranged in parallel, and the locking members are bolts.

The spray gun assembly also includes pipelines 225. One end of each of the pipelines 225 penetrates through the spray gun supporting seat 222 and the installing block 224 and then is connected with the spray gun 221, and the other end is connected with a slip ring assembly 24. In the present embodiment, seven pipelines 225 are arranged, including an anode water passage, a cathode water passage, an anode cable, a cathode cable, a powder conveyance air pipe, a working air pipe and a cooling air pipe. The slip ring assembly 24 includes a stator 241, a transition drum 242 and a rotor flange 243. Inlet ends of the pipelines 225 are located on the stator 241. Inlet ends of the anode water passage, the cathode water passage, the powder conveyance air pipe, the working air pipe and the cooling air pipe are located on a side surface of the stator 241, and a binding post of the anode cable and a binding post of the cathode cable are located on a bottom surface of the stator 241. An upper end of the transition drum 242 is connected with the spray gun supporting seat 222, and a lower end is connected with the rotor flange 243. The rotor flange 243 is rotatably connected with the stator 241. The pipelines 225 penetrate in from a bottom end of the rotor flange 243 and extend out of an upper end of the rotor flange 243, penetrate through the rotor flange 243 and also penetrate through an inner cavity of the transition drum 242. The slip ring assembly 24 ensures reliability and fixation of the pipelines, and continuous rotation of the outputting pipelines and also ensures stable transmission of water, electricity or gas in each pipeline.

The second power mechanism 23 and the slip ring assembly 24 are located in a housing 26. The stator 241 is fixedly connected with the housing 26 through a stator rotation stopping piece 244. The housing 26 can prevent dust from polluting internal mechanical mechanisms in the spraying process, is used to fix a motor, and can apply a certain counter weight to the entire housing 26 to ensure that the spray gun 221 rotates stably and reliably without shaking.

The housing 26 is provided with a pipeline installing notch at a side of the housing corresponding to the inlet end of the pipelines 225, to facilitate installation and connection of the pipelines 225. A pipeline installing hole through which the pipelines 225 penetrate is formed in the rotor flange 243. The second flange 2222 is of an annular structure. A bolt installing hole is formed at an edge of the second flange 2222, and a middle cavity is used for the pipeline 225 to penetrate. A penetrated square hole is formed between two chutes 22211 on the first flange 2221. An installing seat is of a hollow structure which is open in upper and lower ends. The square hole faces openings of the installing seat to facilitate the pipeline 225 to penetrate. A plurality of through holes used to reduce weight are also formed in the first flange 2221.

The second power mechanism 23 is connected with the spray gun assembly 22 through the slip ring assembly 24. The second power mechanism 23 includes a driving pulley 231 and a driven pulley 232. The driving pulley 231 is connected with an output end of a motor 233, and the motor 233 is fixedly connected with the housing 26. The driven pulley 232 is connected with the driving pulley 231 through a belt 234, sleeved on an outer surface of the transition drum 242 and fixedly connected with the transition drum 242. The driven pulley 232 is sleeved on the transition drum 242. In the present embodiment, the driving pulley 231 and the driven pulley 232 are arc tooth pulleys, and the corresponding belts 234 are arc tooth belts.

To further ensure that the spray gun 221 does not shake during rotation, the outer surface of the transition drum 242 is also sleeved by a bearing assembly 25. The bearing assembly 25 includes a bearing seat 251, a bearing 252, spacer rings 253, a first lock nut 254 and a second lock nut 255. The bearing seat 251 is fixedly connected with the housing 26. The bearing 252 is installed in the bearing seat 251 and sleeved on the outer surface of the transition drum 242. The bearing 252 includes a first bearing located above the driven pulley 232 and a second bearing located below the driven pulley 232. Spacer rings 253 are arranged between the driven pulley 232 and the first bearing, between the driven pulley 232 and the second bearing and between the second bearing and a convex edge of a lower end of the transition drum 242, and are configured to axially locate the driven pulley 232, the first bearing and the second bearing. The spacer rings 253 are sleeved on the outer surface of the transition drum 242. The driven pulley 232 is fixedly connected with the transition drum 242 through the spacer rings 253. The bearing seat 251 is fixedly connected with the transition drum 242 through the spacer rings 253. The first lock nut 254 is located on an upper end of the first bearing and fixedly sleeved on the transition drum 242. An internal thread is arranged on the first lock nut 254, and is matched with an external thread on the transition drum 242 at this position. The second lock nut 255 is located on a lower end of the second bearing and is fixedly sleeved on the transition drum 242. An internal thread is arranged on the second lock nut 255, and is matched with an external thread on the transition drum 242 at this position. The first lock nut 254 is matched with the spacer rings 253 and used to axially locate the first bearing. The second lock nut 255 is matched with the spacer rings 253 and used to axially locate the second bearing. A convex edge of a lower end of the transition drum 242 is used to connect with the rotor flange 243 through welding or bolt. In conclusion, the mutual matching of the bearing assembly 25, counterweight 223 and the housing 26 ensures that the spray gun is stable and does not shake during high-speed rotation.

Figure 6:
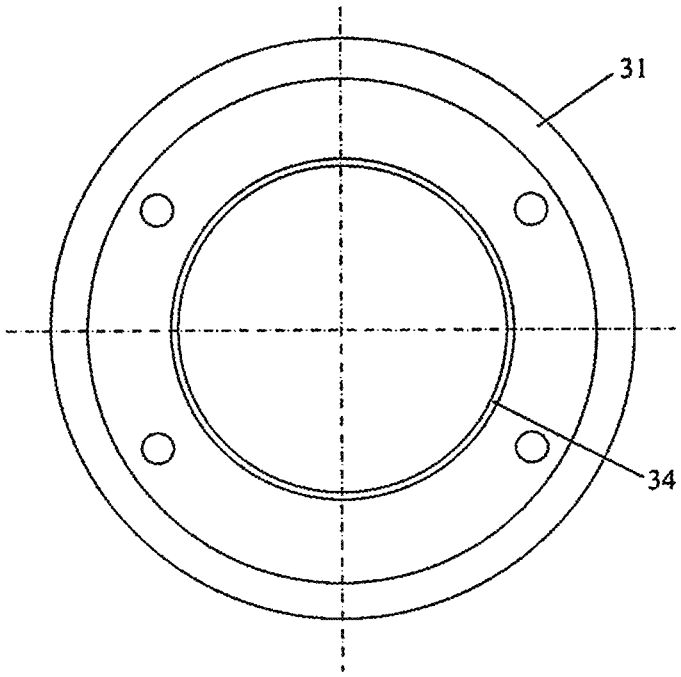
FIG. 6 is a local bottom view illustrating a water cooling assembly of FIG. 2.

By referring to FIG. 2 and FIG. 6, the cooling apparatus is located at a periphery of a cylinder barrel 111. The cooling apparatus includes a water cooling assembly and an air cooling assembly. A composite mode of circulating water cooling and air cooling is adopted to increase cooling degree. In one aspect, an overheated cylinder barrel 111 in the spraying process is prevented from expanding and deforming to a certain degree, thereby avoiding generating a clearance during matching with a piston ring, which damages the sealing property, and causes gas leakage, oil expelling, increase of oil consumption and decrease of engine power; and in another aspect, the coating is prevented from dropping. Since thermal expansion coefficients of materials of the coating and the cylinder barrel 111 are not matched, deformation degrees of the coating and the cylinder assembly 11 are different under the same cooling condition after spraying. When the coating and the cylinder assembly 11 are overheated, a deformation difference therebetween is significantly increased. When generated thermal stress is greater than a binding force between the coating and a basal body, the coating is separated from the cylinder barrel 111 and then drops.

The water cooling assembly includes a circulating water barrel 31 sleeving outside the cylinder barrel 111. An annular water cavity is formed between the circulating water barrel 31 and the cylinder barrel 111. A water inlet 32 and a water outlet 33 which are communicated with the annular water cavity are formed at a side wall of the circulating water barrel 31. The circulating water barrel 31 includes an annular bottom surface and an annular side surface which is connected to an outer circumferential surface of the annular bottom surface. An inner circumferential surface of the annular bottom surface is abutted against an outer circumferential surface of the cylinder barrel 111. The annular water cavity is formed between the annular side surface and the outer circumferential surface of the cylinder barrel 111. The circulating water barrel 31 is installed between the first supporting plate 211 and a cylinder barrel flange. The first supporting plate 211, the circulating water barrel 31 and the cylinder barrel 111 are connected and fixed by a bolt in a bolt hole in the cylinder barrel flange and a bolt hole in the first supporting plate 211 in a corresponding position.

To prevent water seepage on a bottom of the circulating water barrel 31, an O type seal ring 34 is installed on an outer wall, close to the cylinder barrel 111, of an inner circle on the bottom of the circulating water barrel 31. An upper end of the circulating water barrel 31 is just lower than a lowest end of a radiating fin of the cylinder barrel so that a maximum water level of the water filled in the circulating water barrel 31 may exceed an uppermost end of the radiating fin of the cylinder barrel by 4-8 mm.

The water inlet 32 and the water outlet 33 can be located on the same side of the circulating water barrel 31 or located on two opposed sides of the circulating water barrel 31, which is not limited herein. The water inlet 32 and the water outlet 33 are connected with a water pump.

The air cooling assembly includes an annular air pipe 35 sleeved outside a cylinder head 112. The annular air pipe 35 is located above the circulating water barrel 31 and also located at a matching part between the cylinder head 112 and the cylinder barrel 111. The annular air pipe 35 is a copper pipe. An inner diameter of the annular air pipe 35 is greater than a maximum outer diameter of the radiating fin of the cylinder head which directly faces the annular air pipe 35 by 8-16 mm. In the present embodiment, the inner diameter of the annular air pipe 35 is greater than the maximum outer diameter of the radiating fin of the cylinder head which directly faces the annular air pipe 35 by 10 mm.

The annular air pipe 35 is connected with the first supporting plate 211 through a bracket. An air inlet connected with a compressor is formed in the annular air pipe 35, and the air inlet is communicated with an inner cavity of the annular air pipe 35. A plurality of blowing holes 351 are formed in an inner circumferential surface of the annular air pipe 35 which faces the radiating fin of the cylinder head 112. The blowing holes 351 are communicated with the inner cavity of the annular air pipe 35. The blowing holes 351 are evenly distributed along a center of the annular air pipe 35, and an air jetting direction directly faces the annular center.

Figure 7:
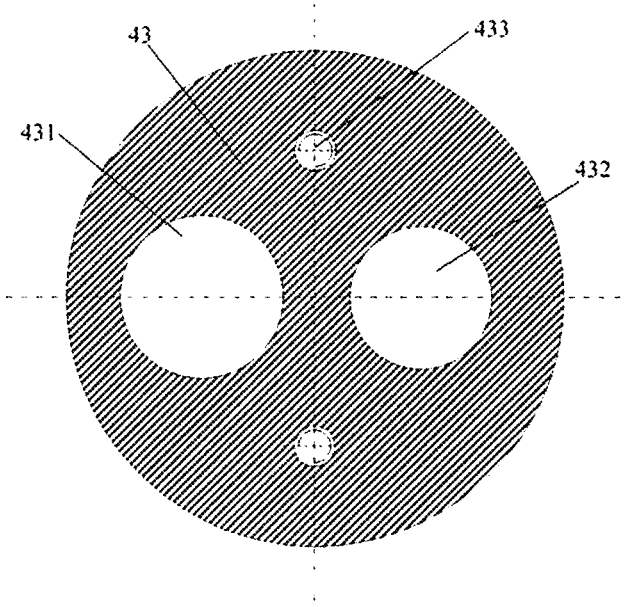
FIG. 7 is a local sectional bottom view illustrating a dustproof shielding cap of FIG. 2.

In the present disclosure, the cylinder assembly 11 is on an upper side, the spray gun 221 is on a lower side and the opening of the blind hole 1111 of the cylinder assembly 11 is downward, such that natural gravitational sedimentation effect of the dust are fully used. However, to further reduce the pollution of the dust, a dust removal apparatus is also arranged on the cylinder assembly 11. By referring to FIG. 2 and FIG. 7, the dust removal apparatus includes an annular air jetting pipe 41, an air jetting channel 42 and a dustproof shielding cap 43.

The annular air jetting pipe 41 is located below the cylinder assembly 11. An air inlet connected with a compressor is formed in the annular air jetting pipe 41, and the air inlet is communicated with an inner cavity of the annular air jetting pipe 41. A plurality of air jetting holes 411 configured to jet air to the inner wall of the blind hole 1111 are formed in a circumferential surface of the annular air jetting pipe 41 close to the cylinder assembly 11. The air jetting holes 411 are communicated with the inner cavity of the annular air jetting pipe 41. The air jetting holes 411 are evenly distributed at intervals along a center of the annular air jetting pipe 41, and an air jetting direction directly faces the blind hole 1111 and is tightly close to an inner wall of the blind hole 1111. The air flow can brush the cylinder assembly 11 or a spread molten drop (coating) which is just generated and can sweep a splashed small molten drop or the dust dispersed near the inner wall of the blind hole 1111, so as to achieve a purpose of purifying the coating on the inner wall.

The annular air jetting pipe 41 is connected with the first supporting plate 211 through a bracket. The annular air jetting pipe 41 is lower than the lower end of the blind hole 1111 by 5-10 mm. An outer diameter of the annular air jetting pipe 41 is smaller than an inner diameter of the blind hole 1111 by 4-8 mm. In the present embodiment, the annular air jetting pipe 41 is lower than the lower end of the blind hole 1111 by 6 mm. The outer diameter of the annular air jetting pipe 41 is smaller than the inner diameter of the blind hole 1111 by 4 mm. Of course, a distance and the inner diameter are not limited herein, and can be adjusted according to actual needs.

The air jetting channel 42 includes a first air channel 421 and a second air channel 422. When a waste cylinder assembly of the aircraft piston engine is repaired, valve mechanisms (an air inlet valve 1121, an air outlet valve 1122, a valve head, a valve rod, a valve neck, a valve spring and the like) are generally disassembled to check ablation of valve clearances, an air inlet valve seat 1123 and an air outlet valve seat 1124, concentricity of valve guide bushings and valves, and the like. An air inlet pipe installing seat is arranged on one side of the air inlet valve 1121 on the cylinder head 112, and an air outlet pipe installing seat is arranged on one side of the air outlet valve 1122. The air inlet pipe is communicated with an interior of the cylinder head 112 through an air inlet hole 1125 in the air inlet pipe installing seat to form an air inlet channel. The air outlet pipe is communicated with the interior of the cylinder head 112 through an air outlet hole 1126 in the air outlet pipe installing seat to form an air outlet channel. Therefore, after the air inlet valve 1121 and the air outlet valve 1122 of the cylinder head 112 are disassembled during repair, looking from an opening at a lower end of the cylinder barrel 111 into a combustion chamber on the bottom of the cylinder head 112, four holes are found, i.e., a round hole in the bottom of the air inlet valve seat 1123, a round hole in the bottom of the air outlet valve seat 1124 and two spark plug installing holes 1127. Favorable air channels (i.e., a first air channel 421 and a second air channel 422) can be established by using this special structure of the cylinder head 112. The first air channel 421 is communicated with the air inlet hole 1125 of the cylinder head 112, and the second air channel 422 is communicated with the air outlet hole 1126 of the cylinder head 112. Compressed airs at two positions meet at the vicinity of a stop point on the cylinder barrel 111 through an air inlet channel and an air outlet channel to form a strong air flow; and air is blown to the opening at the lower end of the blind hole 1111. According to principles of negative pressure dust removal and gas dynamics (i.e., when the air flow passes through an obstacle, air pressure at a leeward of the obstacle is reduced due to the change of speed and the air near the leeward is absorbed and flows under the effect of a pressure difference), if the speed of the air flow is increased, corresponding negative pressure is increased and a "vacuum" region may be formed. Therefore, in the spraying process of the blind hole 1111, as shown by an arrow in FIG. 2, if the two flows of compressed air are led into the cylinder head 112, a large number of dust generated in the cylinder barrel 111 is absorbed into a high-speed air flow channel in the middle of the cylinder barrel 111 under the effect of strong negative pressure, thereby achieving an effect of negative pressure dust removal.

Therefore, under the effect of the annular air jetting pipe 41 and the air jetting channel 42, a flow direction of gas in a spraying environment of the blind hole 1111 can be controlled on the whole; an originally turbulent air flow is forcibly changed to flow in a direction shown by the arrow in FIG. 2; blown fresh air drives the dust in the blind hole 1111 to flow circularly; and under the action of gravitational sedimentation, the dust can be effectively and rapidly discharged into the blind hole 1111.

In the spraying process of the blind hole 1111, whenever the cylinder assembly 11 vertically moves to a position close to a lowest position of a stroke, a plasma flame flow may pollute the combustion chamber on the bottom of the cylinder head 112. Especially, when various self-adhesive powder are sprayed, it is difficult to clean solidified spots on a top portion of the combustion chamber. Therefore, the dustproof shielding cap 43 is detachably arranged in the cylinder barrel 111 and is installed at the matching part between the cylinder barrel 111 and the cylinder head 112 to carry out shielding protection for the top portion of the combustion chamber when spraying.

The material of the dustproof shielding cap 43 can be fiberglass, polytetrafluoroethylene or polyimide, and the dustproof shielding cap 43 has the advantages of resistance to high temperature of 250-300° C., difficult adhesion to dust, and the like. The dustproof shielding cap 43 has a thickness of 4-6 mm. A diameter of the dustproof shielding cap 43 is greater than the inner diameter of the blind hole 1111 by 3-5 mm. Considering that an actual cylinder barrel 111 is not cylindrical, when the actual cylinder barrel 111 is assembled with the cylinder head 112, to ensure tight binding, an upper part of the cylinder barrel 111 is forcibly contracted into a conical shape, such that the dustproof shielding cap 43 with a larger diameter can be installed from the opening at the lower end of the cylinder barrel 111, the dustproof shielding cap 43 is gradually compressed at a boundary between the cylinder head 112 and the cylinder barrel 111, and is finally firmly attached to the top of the combustion chamber; and the dustproof shielding cap 43 is attached to the air inlet valve seat 1123 and the air outlet valve seat 1124. In the present embodiment, the inner diameter of the cylinder barrel 111 is 130.175 mm and the diameter of the dustproof shielding cap 43 is 134 mm.

To ensure that the two flows of compressed air blown from the first air channel 421 and the second air channel 422 are ventilated smoothly, two round holes are also formed in the middle of the dustproof shielding cap 43. The two round holes includes a first round hole 431 aligned with the round hole in the bottom of the air inlet valve seat 1123 and communicated with the air inlet hole 1125 and a second round hole 432 aligned with the round hole in the bottom of the air outlet valve seat 1124 and communicated with the air outlet hole 1126. To fully protect seal end surfaces of the valve seats and prevent spraying particles from being bonded to the seal end surfaces, a diameter of the first round hole 431 is smaller than a diameter of the round hole in the bottom of the air inlet valve seat 1123 by 4-6 mm, and a diameter of the second round hole 432 is smaller than a diameter of the round hole in the bottom of the air outlet valve seat 1124 by 4-6 mm. In the present embodiment, the diameter of the round hole in the bottom of the air inlet valve seat 1123 is 54.483 mm; the diameter of the round hole in the bottom of the air outlet valve seat 1124 is 44.196 mm; the diameter of the first round hole 431 is 50 mm and the diameter of the second round hole 432 is 40 mm.

In addition, two internal thread positioning holes 433 are also formed in the dustproof shielding cap 43, and the two internal thread positioning holes 433 directly face the spark plug installing holes 1127 on two ends of the cylinder head 112. After the dustproof shielding cap 43 is assembled, external thread positioning pins are screwed into positioning holes 433 through the spark plug installing holes 1127 to ensure that the first round hole 431 and the second round hole 432 of the dustproof shielding cap 43 respectively directly face the round hole in the bottom of the air inlet valve seat 1123 and the round hole in the bottom of the air outlet valve seat 1124. After spraying, two positioning pins are pushed downwards so that the dustproof shielding cap 43 is taken out.

The present disclosure further provides a process for remanufacturing a waste cylinder assembly of an aircraft piston engine. Plasma spraying on the blind hole 1111 of the cylinder assembly 11 with the above system for remanufacturing the waste cylinder assembly of the aircraft piston engine and specifically including the following steps.

In step 1: pretreatment is performed on a basal body. Before spraying, the waste cylinder assembly shall be pretreated. The pretreatment includes machining, washing, drying and sand blasting, and the like. Firstly, surface defects such as corrosion, scratch, abnormal abrasion and the like of the inner wall of the blind hole 1111 are removed to repair the inner wall of the blind hole 1111 for making the inner diameter of the blind hole uniform and to reduce later pollution to sand used in sandblasting. Then, a workpiece is placed into a large ultrasonic cleaner with industrial cleaning agents so as to remove impurities such as grease and dust on an inner surface and an outer surface (including hidden corners and dead corners) of the complex workpiece. After cleaning, fresh compressed air is used immediately to dry the blind hole 1111 so as to prevent rust; and then, the inner wall of the blind hole 1111 is sandblast through an inner hole sandblasting gun so as to form a clean rough surface, thereby increasing mechanical binding force between molten sprayed particles and the surface of the inner wall of the cylinder barrel 111 and enhancing bonding strength of the sprayed layer of the inner hole.

In the sandblasting, the type of the sand is regular fused alumina with a particle size of 500-800 μm, a sandblasting distance of 30-70 mm, a sandblasting angle of 80-100 degrees, a gas pressure of 0.4-0.7 MPa and a surface roughness Ra of 2-5 μm after sandblasting.

In step 2: the remanufacturing system is jointly adjusted. The dustproof shielding cap 43 is installed on the top of the combustion chamber at the bottom of the cylinder head 112 from the opening at the lower end of the blind hole 1111 and then fixed. The position of the dustproof shielding cap 43 is adjusted and fastened through two positioning holes 433, and the first round hole 431 and the second round hole 432 are kept to respectively directly face the round hole in the bottom of the air inlet valve seat 1123 of the cylinder head 112 and the round hole in the bottom of the air outlet valve seat 1124. The cylinder assembly 11, the cooling apparatus and the dust removal apparatus are connected with the first supporting plate 211, and the first power mechanism 21 is adjusted so that a center of the blind hole 1111 directly faces a rotating center of the spray gun assembly 22.

The pipeline 225 is connected with the spray gun 221 and the slip ring assembly 24. The position of the spray gun 221 on the spray gun supporting seat 222 is adjusted according to the inner diameters of cylinder barrels of aircraft piston engines so that a back surface of the spray gun 221 is close to the inner wall of the blind hole 1111; the nozzle faces the inner wall of the blind hole 1111 on the other side along a diameter direction so as to increase a spraying distance as much as possible under the condition that a small inner hole is limited; and then the installing block 224 and the spray gun supporting seat 222 are fixed through bolts. Meanwhile, a design maximum bending moment during rotation of the spray gun 221 is calculated according to the spraying distance, so as to adjust the weight of the counterweight 223.

The annular air pipe 35, the annular air jetting pipe 41 and the air jetting channel 42 are communicated, and an approximate height of circulating water is fed into a circulating water barrel 31 until a liquid level is higher than a radiating fin of the cylinder barrel on an uppermost position of the cylinder barrel 111 by 4-8 mm, such that the cooling apparatus and the dust removal apparatus are operated normally.

In step 3: the spray gun 221 is rotated and a plasma spraying layer is prepared. Spraying is conducted, selected powder material is sprayed on the inner surface of the blind hole 1111. In the spraying process, the cylinder assembly 11 is driven by a motor to move up and down along a vertical direction, and the spray gun 221 reliably and stably rotates in a horizontal plane at certain rotating speed. Specifically, a flow of primary gas Ar is: 40-120 L/min; a flow of secondary gas $H_2$ or $N_2$ is: 3-15 L/min; voltage is: 40-120 V; current is: 300-500 A; powder delivery quantity is: 20-60 g/min; rotating speed of the spray gun is 50-300 rpm; and the vertical movement speed of the cylinder assembly 11 is 200-800 mm/min. The spray distance depends on the type of cylinder assembles 11 to be sprayed and is flexibly adjusted on this basis and is generally 40-80 mm. A reciprocating travel of spraying is from a position lower than the opening at the lower end of the cylinder barrel 111 by 12-15 mm to a position higher than a stop point on the cylinder barrel 111 by 12-15 mm.

The movement speed and the rotating speed of the spray gun 221 in the vertical direction are coordinated according to deposition efficiency of different powders under specific process parameters, the actual inner diameter of the cylinder barrel and the reciprocating travel of spraying; and a size error of coating thickness is controlled within 50 μm through accurate calculation, to facilitate later machining operation. The thickness of the prepared coating may be between 0.2 and 0.4 mm. For a thicker coating, the coating is made by multiple times of spraying to prevent low speed of one spraying and avoid overheating the cylinder assembly 11.

In step 4, post process is performed on the coating of the inner hole. After spraying, the dustproof shielding cap 43 is taken out of the cylinder assembly 11 through two positioning pins of the dustproof shielding cap 43. The thickness of the added coating is ground to a standard inner diameter of a engine cylinder barrel through an inner hole honing device; and the surface of the coating achieves specified surface roughness and texture, where the surface roughness is Ra 0.635 μm-0.889 μm, and the texture is a crossed mesh of 45 degrees.

The technical solution of the present disclosure is described below by taking a waste cylinder assembly of an aircraft piston engine (Lycoming IO-540-K with six-cylinder engine horizontally opposed, a horsepower of 300 and an inner diameter of cylinder barrel of 130.175 mm) as a remanufacturing example.

Figure 8:
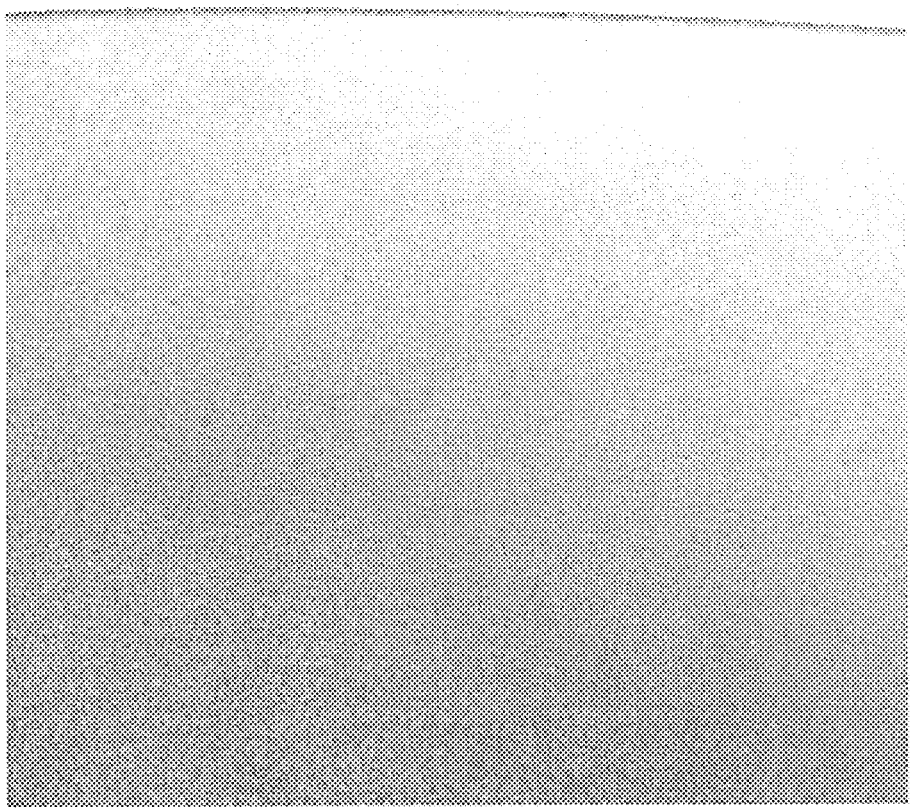
FIG. 8 is a diagram illustrating a coating on an inner wall of a blind hole formed by the process for remanufacturing a waste cylinder assembly of an aircraft piston engine according to the present disclosure.
Figure 9:
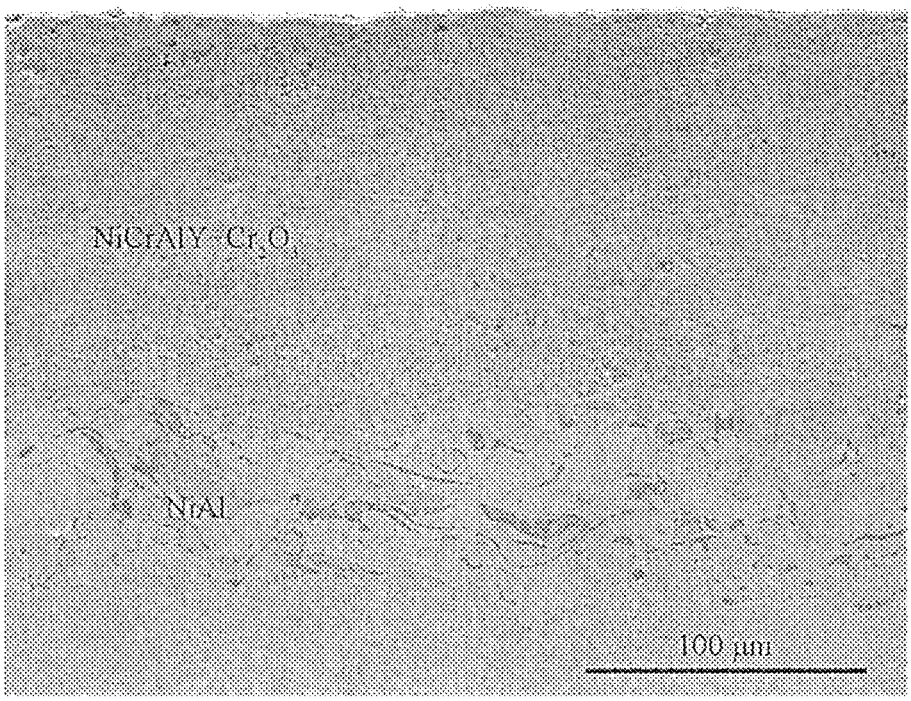
FIG. 9 is an enlarged sectional view of the coating on the inner wall of the blind hole of the inner hole in FIG. 8 after being horned.

The pretreating of a basal body and joint adjusting of the remanufacturing system of the waste assembly are conducted according to above step 1) and step 2). The position of the spray gun 221 on the spray gun supporting seat 222 is adjusted so that the spray gun 221 has a maximum spraying distance of about 80 mm. In the step of preparing the coating, to enhance the binding strength of the inner hole coating, firstly, an Ni/Al coating is prepared on the inner wall of the blind hole 1111 of the cylinder barrel 111 by using Ni-coated Al powder (content: 80 wt. % of Ni and 20 wt. % of Al), where a flow of primary gas (Ar) is: 50 L/min; a flow of secondary gas ($H_2$ or $N_2$) is: 5 L/min; voltage is: 80 V; current is: 300 A; powder delivery quantity is: 30 g/min; rotating speed of the spray gun 221 is 180 rpm; and the vertical movement speed of the cylinder assembly 11 is 480 mm/min. The cylinder assembly 11 reciprocates for four times in an up-down direction so that the thickness of a base layer is 70-90 Then, a composite coating NiCrAlY+$Cr_2O_3$ is prepared on the base layer (the used powder is micrometer-scale composite powder agglomerated by spray granulation of submicron-scale NiCrAlY and 15 wt. % of $Cr_2O_3$), where a flow of primary gas (Ar) is: 50 L/min; a flow of secondary gas ($H_2$ or $N_2$) is: 6.5 L/min; voltage is: 100 V; current is: 350 A; powder delivery quantity is: 30 g/min; rotating speed of the spray gun 221 is 180 rpm; and the vertical movement speed of the cylinder assembly 11 is 480 mm/min. The cylinder assembly 11 reciprocates for ten times in the up-down direction so that the thickness of a working layer is 190-200 μm. The total thickness of two coatings is about 260-300 μm and a macro appearance of the prepared inner wall coating is shown in FIG. 8. In the spraying process, the spray gun 32 rotates stably and reliably, and the composite cooling apparatus of circulating water cooling and air cooling and the dust removal apparatus are operated normally to conduct powerful refrigeration and dust removal. Finally, the dustproof shielding cap 43 is taken out and the sprayed inner hole of the cylinder barrel 111 is honed, so that the total thickness of the coatings is reduced by 210-240 μm and achieves a specified surface roughness. An amplified appearance of a section of the obtained inner hole coating is shown in FIG. 9.

Above embodiments only illustrate basic principles and characteristics of the present disclosure. The present disclosure is not limited by above embodiments. Various changes and variations can be made to the present disclosure on a premise of not departing from spirit and scope of the present disclosure. These changes and variations shall fall into the claimed scope of the present disclosure. The claimed scope of the present disclosure is defined by appended claims and equivalents.

What is claimed is:

1. A system for remanufacturing a waste cylinder assembly of an aircraft piston engine, being configured to conduct plasma spraying on a blind hole of the cylinder assembly and comprising a spraying apparatus, wherein the spraying apparatus comprises:

a first power mechanism configured to drive the cylinder assembly to move in a horizontal direction and a vertical direction, wherein the first power mechanism is configured to be connected with the blind hole in such a manner that an opening of the blind hole is downward;

a spray gun assembly comprising a spray gun and a spray gun supporting seat, wherein a nozzle end of the spray gun is configured to extend into the blind hole; a pipeline end of the spray gun is slidably connected with the spray gun supporting seat; and a distance from the spray gun to a rotating center of the spray gun assembly is adjustable; and a second power mechanism configured to drive the spray gun assembly to rotate around a center of the blind hole;

wherein the pipeline end of the spray gun is slidably connected with the spray gun supporting seat through an installing block, and the spray gun assembly further comprises:

a counterweight arranged on the spray gun supporting seat and configured to hold dynamic balance of the spray gun during rotation; and a pipeline, wherein one end of the pipeline penetrates through the spray gun supporting seat and the installing block and is connected with the spray gun, the other end of the pipeline is connected with a slip ring assembly, and the second power mechanism is connected with the spray gun assembly through the slip ring assembly; and wherein the second power mechanism and the slip ring assembly are located in a housing and the slip ring assembly comprises:

a stator fixedly connected with the housing through a stator rotation stopping piece, wherein an inlet end of the pipeline is located on the stator;

a rotor flange rotatably connected to an upper end of the stator; and a transition drum, wherein an upper end of the transition drum is connected with the spray gun supporting seat, a lower end of the transition drum is connected with the rotor flange and the pipeline penetrates through the rotor flange and an inner cavity of the transition drum.

2. The system for remanufacturing the waste cylinder assembly of the aircraft piston engine according to claim 1, wherein the spray gun supporting seat comprises a first flange and a second flange; the first flange and the second flange are connected through a plurality of connecting rods; the first flange is provided with a chute; and the installing block is slidably connected with the chute and is positioned and fastened through a locking member.

3. The system for remanufacturing the waste cylinder assembly of the aircraft piston engine according to claim 1, wherein the second power mechanism comprises:

a driving pulley connected with an output end of a motor which is fixedly connected with the housing; and a driven pulley connected with the driving pulley through a belt, sleeved on an outer surface of the transition drum and fixedly connected with the transition drum.

4. The system for remanufacturing the waste cylinder assembly of the aircraft piston engine according to claim 3, wherein the outer surface of the transition drum is also sleeved by a bearing assembly, and the bearing assembly comprises:

a bearing seat fixedly connected with the housing;

a bearing installed on the bearing seat and sleeved on the outer surface of the transition drum, wherein the bearing comprises a first bearing located above the driven pulley and a second bearing located below the driven pulley; spacer rings are arranged between the driven pulley and the first bearing, between the driven pulley and the second bearing and between the second bearing and a convex edge of a lower end of the transition drum; and the driven pulley is fixedly connected with the spacer rings;

a first lock nut located on an upper end of the first bearing and fixedly sleeved on the transition drum to axially locate the first bearing; and a second lock nut located on a lower end of the second bearing and fixedly sleeved on the transition drum to axially locate the second bearing.

5. The system for remanufacturing the waste cylinder assembly of the aircraft piston engine according to claim 1, wherein the first power mechanism comprises:

a vertical regulating mechanism comprising a first supporting plate connected with the cylinder assembly and a second supporting plate slidably connected with the first supporting plate, wherein the first supporting plate is provided with a through hole corresponding to the blind hole; and a horizontal regulating mechanism comprising a base connected to a lower end of the second supporting plate, wherein the second supporting plate is slidably connected with a sliding rail on the base.

6. The system for remanufacturing the waste cylinder assembly of the aircraft piston engine according to claim 1, further comprising a cooling apparatus located at a periphery of a cylinder barrel of the cylinder assembly, wherein the cooling apparatus comprises a water cooling assembly; the water cooling assembly comprises a circulating water barrel sleeved on the cylinder barrel; an annular water cavity is formed between the circulating water barrel and the cylinder barrel; and a side wall of the circulating water barrel is provided with a water inlet and a water outlet which are communicated with the annular water cavity.

7. The system for remanufacturing the waste cylinder assembly of the aircraft piston engine according to claim 6, wherein the cooling apparatus further comprises an air cooling assembly; the air cooling assembly comprises an annular air pipe sleeved on a cylinder head of the cylinder assembly; the annular air pipe is located above the circulating water barrel and located at a matching part between the cylinder barrel and the cylinder head; and an inner circumferential surface of the annular air pipe which faces a radiating fin of the cylinder head is evenly provided with a plurality of blowing holes communicated with an inner cavity of the annular air pipe.

8. The system for remanufacturing the waste cylinder assembly of the aircraft piston engine according to claim 1, further comprising a dust removal apparatus, wherein the dust removal apparatus comprises:

an annular air jetting pipe located below the cylinder assembly, wherein a circumferential surface of the annular air jetting pipe close to the cylinder assembly is provided with a plurality of air jetting holes communicated with an inner cavity of the annular air jetting pipe and configured to jet air to an inner wall of the blind hole; and an air jetting channel comprising a first air channel and a second air channel, wherein the first air channel is communicated with an air inlet hole in the cylinder head of the cylinder assembly and the second air channel is communicated with an air outlet hole in the cylinder head.

9. The system for remanufacturing the waste cylinder assembly of the aircraft piston engine according to claim 8, wherein the dust removal apparatus further comprises a dustproof shielding cap which is detachably located in the cylinder barrel of the cylinder assembly and installed at the matching part between the cylinder barrel and the cylinder head to shield a combustion chamber of the cylinder head.

10. A system for remanufacturing a waste cylinder assembly of an aircraft piston engine, being configured to conduct plasma spraying on a blind hole of the cylinder assembly and comprising a spraying apparatus, wherein the spraying apparatus comprises:

a first power mechanism configured to drive the cylinder assembly to move in a horizontal direction and a vertical direction, wherein the first power mechanism is configured to be connected with the blind hole in such a manner that an opening of the blind hole is downward;

a spray gun assembly comprising a spray gun and a spray gun supporting seat, wherein a nozzle end of the spray gun is configured to extend into the blind hole; a pipeline end of the spray gun is slidably connected with the spray gun supporting seat and a distance from the spray gun to a rotating center of the spray gun assembly is adjustable; and a second power mechanism configured to drive the spray gun assembly to rotate around a center of the blind hole;

wherein the pipeline end of the spray gun is slidably connected with the spray gun supporting seat through an installing block, and the spray gun assembly further comprises:

a counterweight arranged on the spray gun supporting seat and configured to hold dynamic balance of the spray gun during rotation; and a pipeline, wherein one end of the pipeline penetrates through the spray gun supporting seat and the installing block and is connected with the spray gun, the other end of the pipeline is connected with a slip ring assembly, and the second power mechanism is connected with the spray gun assembly through the slip ring assembly; and wherein the spray gun supporting seat comprises a first flange and a second flange; the first flange and the second flange are connected through a plurality of connecting rods; the first flange is provided with a chute; and the installing block is slidably connected with the chute and is positioned and fastened through a locking member.

11. A system for remanufacturing a waste cylinder assembly of an aircraft piston engine, being configured to conduct plasma spraying on a blind hole of the cylinder assembly and comprising a spraying apparatus and a dust removal apparatus, wherein the spraying apparatus comprises:

a first power mechanism configured to drive the cylinder assembly to move in a horizontal direction and a vertical direction, wherein the first power mechanism is configured to be connected with the blind hole in such a manner that an opening of the blind hole is downward;

a spray gun assembly comprising a spray gun and a spray gun supporting seat, wherein a nozzle end of the spray gun is configured to extend into the blind hole; a pipeline end of the spray gun is slidably connected with the spray gun supporting seat and a distance from the spray gun to a rotating center of the spray gun assembly is adjustable; and a second power mechanism configured to drive the spray gun assembly to rotate around a center of the blind hole; and wherein the dust removal apparatus comprises:

an annular air jetting pipe located below the cylinder assembly, wherein a circumferential surface of the annular air jetting pipe close to the cylinder assembly is provided with a plurality of air jetting holes communicated with an inner cavity of the annular air jetting pipe and configured to jet air to an inner wall of the blind hole; and an air jetting channel comprising a first air channel and a second air channel, wherein the first air channel is communicated with an air inlet hole in the cylinder head of the cylinder assembly and the second air channel is communicated with an air outlet hole in the cylinder head.

12. The system for remanufacturing the waste cylinder assembly of the aircraft piston engine according to claim 11, wherein the dust removal apparatus further comprises a dustproof shielding cap which is detachably located in the cylinder barrel of the cylinder assembly and installed at the matching part between the cylinder barrel and the cylinder head to shield a combustion chamber of the cylinder head.

* * * * *